United States Patent [19]

Frank

[11] 4,081,162

[45] Mar. 28, 1978

[54] RAILROAD FROGS

[75] Inventor: Earl E. Frank, Tallman, N.Y.

[73] Assignee: Abex Corporation, New York, N.Y.

[21] Appl. No.: 779,620

[22] Filed: Mar. 21, 1977

[51] Int. Cl.[2] ..... E01B 7/10

[52] U.S. Cl. ..... 246/458; 246/454; 246/468

[58] Field of Search ..... 246/454, 457, 458, 468, 246/464, 275, 382

[56] References Cited

U.S. PATENT DOCUMENTS

| | | | |
|---|---|---|---|
| 2,024,566 | 12/1935 | Caruthers | 246/464 |
| 2,346,377 | 4/1944 | Houston | 246/464 |
| 3,263,076 | 7/1966 | Magnus | 246/454 |

*Primary Examiner*—Trygve M. Blix
*Assistant Examiner*—Reinhard J. Eisenzopf
*Attorney, Agent, or Firm*—Kinzer, Plyer, Dorn & McEachran

[57] ABSTRACT

Wheel loads on the running surfaces of a frog point and its (cast) integral wings are distributed to the ties by a bottom wall boxing in the side walls which support those running surfaces and by strategically located center ribs.

2 Claims, 9 Drawing Figures

RAILROAD FROGS

Figures 1A, 1B, 2:
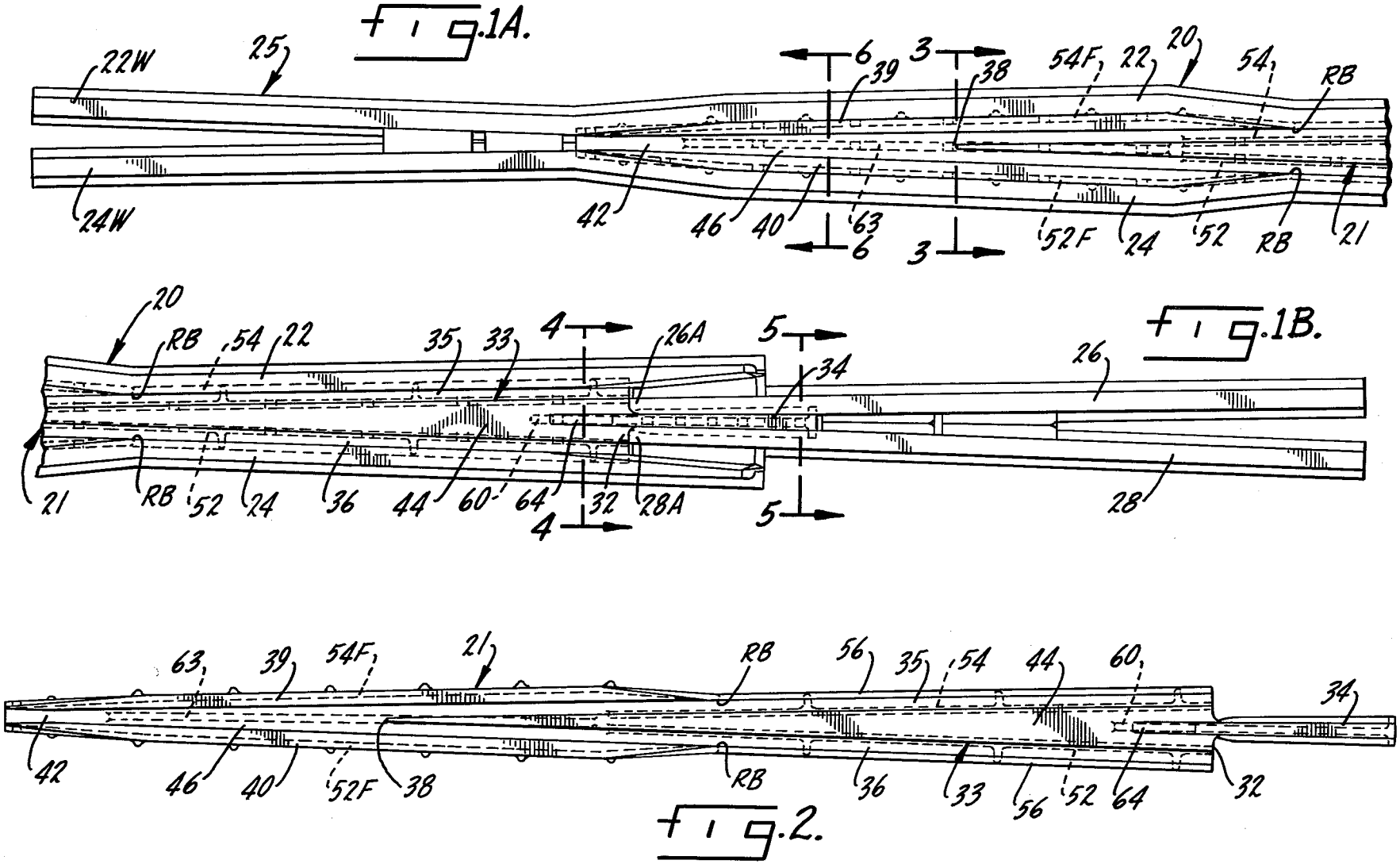

This invention relates to railroad trackwork and more particularly to railbound frogs employed at turnouts and crossings.

A railroad frog is a large piece of trackwork introduced at the intersection of two converging running rails to permit the wheels moving along one rail to cross over to the other. The frog may be installed at a crossing, where two main tracks cross one another, or it may be installed at a turnout, where traffic is diverted by a switch.

The two running rails mentioned in the definition just given are simply two crossing rails (at an intersection of the two tracks for example) where it is essential that the rails be discontinuous, so the wheel flanges can make the cross-over, and also that there be guiding surfaces (flangeways) which assure the wheel does not become disrailed when traversing the discontinuity or gap between the throat and actual point of frog.

Inherent to the construction of the railbound frog is a triangular shaped center part presenting a running surface for the treads of the wheels and flangeways in which the flanges of the wheels travel; there are two flangeways which converge toward one another and in doing so meet at what is known as the theoretical point which is an immaginary point a few inches forward of the tip end of the frog point.

The frog is invariably a one piece casting, usually of manganese steel. It comprises a center part known as the frog point and wings which cooperate with the point to define the flangeways. The frog point extends rearward from the tip and in doing so presents a running surface of gradually increasing width. The tread of the wheel rides on this running surface with its flange in one or the other of the flangeways depending upon the direction of movement.

The flanges of the wheels, in traversing the point, are presented to the part of the point known as the gage line which is a vertical wall, slightly sloped, and of course the tread of the wheel is supported by the running surface as already noted. There are two gage lines, one on each side of the frog. The gage lines aid in guiding the wheel across the running rail intersection. Any fault in the gage line, if serious enough, can result in a derailment.

The point at its rearward end terminates in a heel and heel extension. The heel may be simply viewed as the base of the triangular part of the point; the heel extension extends rearward therefrom and is of less width than the heel to afford space enabling the ends of the heel running rails to be abutted to the heel of the frog so that the heads of the running rails (which support the treads of the wheels) are aligned to the gage lines and to the running surface of the frog point as well.

Manganese steel is the preferred metal for the railbound frog casting because that steel is inherently work hardening, that is, it has an inherent tendency to wear better (last longer under impact) than other steels. Nonetheless there is a limit to anything such that even the manganese frog can at times exhibit evidence of failing under the applied forces resulting from higher train speeds and greater wheel loading. This is the problem confronted by the present invention.

It has been proposed the problem be solved by thickening the portions of the point susceptible to distortion under the larger forces being experienced. That solution, though seemingly attractive, is not realistic because a thicker or more bulky section of manganese steel is likely to develop internal defects in the form of shrinkage porosity: as the outer surfaces solidify after being cast, they shrink somewhat and molten metal at the center of the casting, not yet solidified, itself becomes a feeder or riser, feeding molten metal to the solidifying mass and resulting in a void space inside the casting representing the volume of metal lost to the outer part of the casting.

It was also reasoned that by thickening the section of manganese steel this would also prevent the gage lines from spreading outward (spring effect) due to heavier wheel loads, for if the gage lines spread apart this means the flangeway space is diminished. This proposal is deemed inappropriate for the reasons already given because any shrink porosity will weaken the casting, contributing to the problem and not solving it.

My solution is different and the advantages have become publicly acknowledged. I have proposed that the side walls which are present on the known frog be boxed in at critical locations, so to speak, with a bottom wall cast integral with the side walls, with the bottom wall in position to rest on either the tie plate or on the wing rail flanges; also, that the running surfaces of the wings, adjacent the throat end of the frog, and the running surface at the heel end each be supported by another wall (center rib) joined to the aforesaid bottom wall. In this manner the integrity of the gage lines and running surfaces may be preserved to a greater extent than at present.

Figure 3:
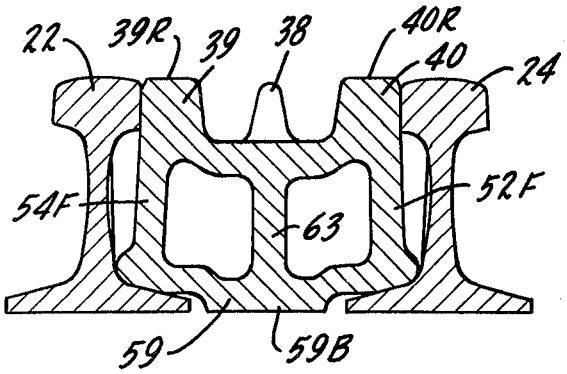
Figure 4:
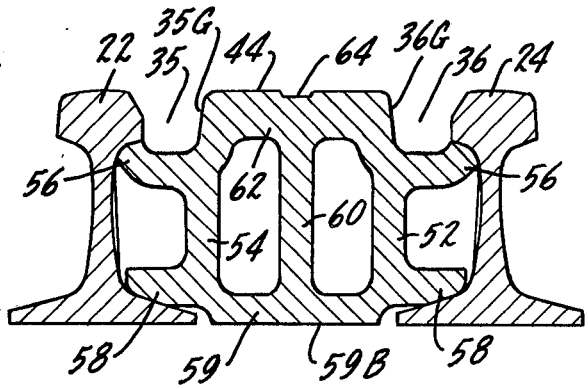
Figure 5:
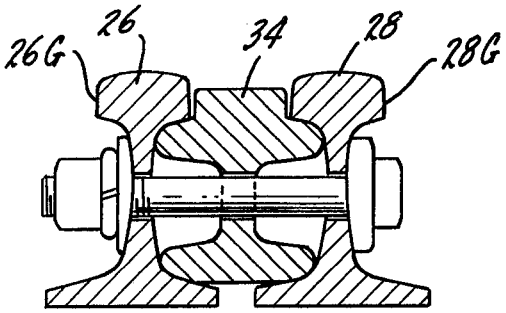

In the drawing:

FIGS. 1A and 1B, combined, constitute a plan view of a frog installation incorporating a frog constructed in accordance with the present invention;

FIG. 2 is a plan view of the frog casting by itself;

FIGS. 3, 4, 5 and 6 are sectional views on the corresponding lines of FIGS. 1A and 1B, FIGS. 7 and 8 are sectional views similar to FIGS. 3 and 4 showing a modified form of frog casting in accordance with the present invention;

The frog installation 20 shown in FIGS. 1A and 1B is a railbound frog installation in that the frog casting 21 is supported on the flanges or bases of the associated wing rails 22 and 24 which are extended leftward as viewed in FIG. 1 to constitute the left and right wing rails 22W and 24W at the toe end 25.

The two running rails 26 and 28 at the heel end of the frog casting are not part of that casting; rather, their ends 26A and 28A abut the frog heel 32 of the frog point 33 and are spaced accurately by the heel extension 34 of the frog casting so that the gage lines 26G and 28G, FIG. 4, of the two running rails accurately match the gage lines of the frog point hereinafter identified.

The wing rails in the medial area of the installation are spaced from the adjacent sides of the frog point 33 to afford the two necessary flangeways 35 and 36 in which the wheel flanges travel.

The flangeways extend all the way from the heel of the frog to the tip or point end 38 of the frog known as the "actual point of frog." The flangeways are also defined in part by wings 39 and 40 which are part of the frog casting 21. The wings 39 and 40 are supported on the flanges of the wing rails which bend around the wings. The wings extend from the wing rail bends RB to points a little forward of the frog throat 42.

The upper surface of the frog point 33 is essentially flat, constituting the running surface 44, FIG. 2, which narrows forwardly from maximum width at the heel end. The very tip or point end 38 of the frog point does not take a wheel load; its upper surface, as shown in FIG. 2, is slightly below the tread support surfaces of the wings as can be seen in FIG. 3 and slopes upwardly with a gradual rise of about ¼ of an inch per foot until it merges into the actual running surface 44 of the point.

The running surface 44, FIG. 3, at its opposite sides meets the gage lines of the frog point denoted by 35G and 36G, FIG. 4. These two gage lines must be maintained in alignment with the gage lines 26G and 28G of the two running rails and as well with the gage lines of the wing rail extensions 22W and 24W at the toe end 25 of the frog installation.

Figure 6:
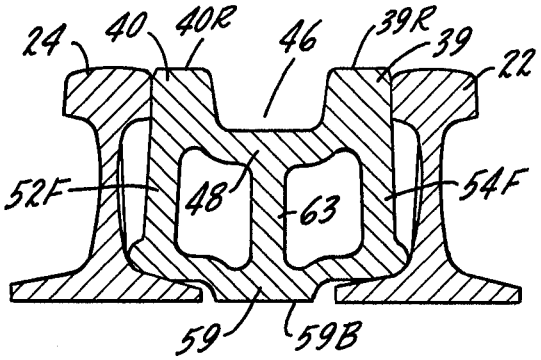
Figure 7:
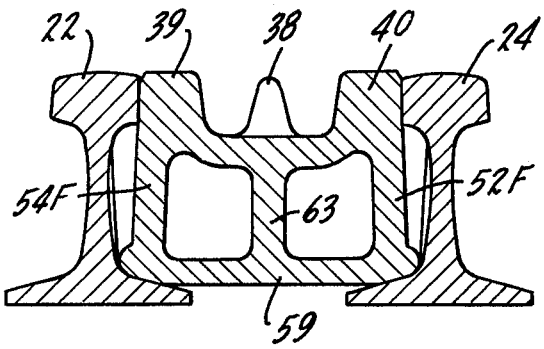
Figure 8:
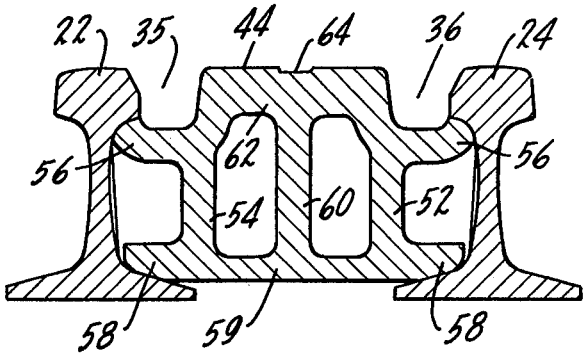

The wings 39 and 40 of the frog casting also have running surfaces, denoted 39R and 40R, FIG. 3. As shown in FIG. 6, the running surfaces of the wings are spaced laterally from one another to afford a wing flangeway 46 the bottom of which is defined by a transverse web 48.

A pair of vertical side walls 52 and 54 lie under the gage lines of the frog point in supporting relation. Lateral projections as 56 and 58, FIG. 4, extend outwardly of the frog point side walls and respectively fit complementally beneath the heads of the wing rails and wedge on the upper surfaces of the wing rail flanges, characterizing the railbound configuration which is known.

The side walls 52 and 54 extend from the heel of the frog forwardly toward the actual point of frog 38, terminating approximately thirty inches (not critical) forwardly of the bends RB in the wing rails and at that point the side walls are forked outwardly and extend forwardly at 52F and 54F in supporting relation to the running surfaces of the wings as can be seen in FIGS. 3 and 6.

The side walls of the frog casting are boxed in by a horizontal bottom wall 59 which is continuous from the heel end of the frog casting to the throat end of the wings 39 and 40, integrally joining the lower extremities of the side walls, all as part of the one-piece frog casting.

As shown in FIGS. 3, 4 and 6 the base surface 59B of the bottom wall lies in the common plane of the bases of the wing rails so that wheel loading on the side walls is borne at least in part by the rail ties (not shown) which support the wing rails, although it is customary to interpose tie plates (not shown). However, in a modified form of casting, shown in FIGS. 7 and 8, the bottom wall may be higher and provided with lateral extremities reposing on the flanges of the wing rails but again wheel loads are in effect borne by the railroad ties.

To further distribute the wheel loads bearing on the running surface 44 of the frog point, a center rib or strut 60, FIGS. 2 and 4, is positioned between the side walls, joining the bottom wall 59 and the top wall 62 which presents the running surface 44 at the heel end. Thus the rib 60 extends from the heel 32 of the frog point forwardly a short distance sufficiently to help bear the brunt of the wheel loading which occurs when a wheel crosses the butt joint between a running rail and the frog heel; that load on rib 60 is transferred to the bottom wall at the heel end of the frog.

Similary, a center rib 63 is positioned between the side wall extensions which support the wing running surfaces, FIGS. 2, 3 and 6, and joins the bottom wall 56 to the wing web 48. Rib 63 may commence at a point a few inches rearward of the frog throat, extending rearwardly in supporting relation to both the flangeway web and the running surface 44 of the point rearward of the actual point of frog for about 20 inches or so.

Preferably the running surface at the heel end of the frog, immediately above the center rib, is depressed slightly at 64.

I claim:

1. In a railbound railroad frog casting bounded on opposite sides by separate wing rails, a one-piece frog casting comprising: frog point, said frog point terminating at a rear end in a heel and heel extension and at the opposite end in an actual point of frog, a pair of wings each spaced laterally from a respective side of the frog point to afford flangeways therewith and defining a frog throat forward of said actual point of frog, said wings having respective wheel tread running surfaces adjacent the throat, said frog point having a horizontal top wall presenting a substantially flat wheel tread running surface of triangular form in plan view which is widest at the heel and narrows toward the actual point of frog, said running surface being bounded at the opposite sides by respective gage lines extending immediately downwardly therefrom with laterally spaced side walls substantially centered on and located directly beneath the respective gage lines in supporting relation thereto, said side walls also extending toward the frog throat and supporting the wing running surfaces, a horizontal bottom wall joining the lower extremities of the two side walls from the heel end forwardly toward the actual point of frog, a vertical center rib located between the two side walls and joining the top wall and the bottom wall beneath the running surface at the heel end of the frog point and extending forwardly thereof, a top web joining the wings forwardly of the actual point of frog, said bottom wall being extended forwardly and joined to the forward extensions of the side walls, a vertical center rib joining said web and the forward extension of said bottom wall; said wing rails being positioned outwardly of the wings of the casting in abutting relation thereto, and in which the bottom wall has lateral extremities reposing on the flanges of the wing rails so that wheel loading on the frog is borne at least in part by the wing rails.

2. A frog casting according to claim 1 in which said extremities are directly beneath the side walls and in which the bottom wall has a lower surface coplanar with the base surfaces of the wing rails so that wheel loading on the frog is borne at least in part by the railroad ties.

* * * * *